United States Patent [19]

Evrard

[11] Patent Number: 4,798,307

[45] Date of Patent: Jan. 17, 1989

[54] COMPARTMENTED CLEANING BUCKET

[76] Inventor: William E. Evrard, SS Rte., Box 312-W, West Plains, Mo. 65775

[21] Appl. No.: 143,757

[22] Filed: Jan. 14, 1988

[51] Int. Cl.[4] ..... A47L 13/14

[52] U.S. Cl. ..... 220/20.5; 15/264

[58] Field of Search ..... 220/20.5; 15/257.4, 15/264

[56] References Cited

U.S. PATENT DOCUMENTS

| | | | |
|---|---|---|---|
| 1,488,930 | 4/1924 | Mannix | 15/264 |
| 2,671,239 | 3/1954 | Wisner | 15/264 X |
| 2,712,668 | 7/1955 | Thiele | 15/264 |
| 2,865,041 | 12/1958 | Koontz | 15/264 |
| 3,630,369 | 12/1971 | Nichols | 15/264 X |
| 4,161,799 | 7/1979 | Sorrells | 15/264 X |

*Primary Examiner*—Steven M. Pollard
*Attorney, Agent, or Firm*—Harvey A. Gilbert

[57] ABSTRACT

A bucket having separate reservoirs for segregating clean wash liquid, such as water, from dirty or contaminated wash liquid. In addition, the bucket contains a discharge transfer compartment for wringing a mop and providing for the immediate transfer of its discharge to a discharge storage reservoir by way of holes in the floor connecting the discharge transfer compartment and said reservoir. The floors of the discharge transfer compartment and the clean liquid reservoir are shaped with adequate slope or curvature so that particulate material discharged in either is caused to move to the lowest point for removal. Further, the clean liquid reservoir contains a shelf with holes sized to permit the passage of any residual particulate material transferred by a wrung mop entering the clean water to the curved bottom of said reservoir under said shelf so that it cannot be disturbed by the reentry of the mop in the portion of the reservoir above the shelf and thereby reenter solution and re-contaminate the mop. The clean liquid reservoir contains a drain port for emptying residual wash or bucket cleaning liquid after use into the discharge storage reservoir at the bottom of the bucket below said clean liquid reservoir. The discharge storage reservoir can be emptied of all residual liquid remaining in the bucket after use or bucket cleaning into a floor drain by means of a similar drain port without the necessity of the bucket being lifted. The bucket is mounted on four (4) casters to enhance mobility.

2 Claims, 1 Drawing Sheet

COMPARTMENTED CLEANING BUCKET

FIELD OF THE INVENTION

The present invention is a wash bucket and, more particularly a wash bucket having separate compartments for dirty and clean wash liquids.

BACKGROUND OF THE INVENTION

It should be understood in the discussion that follows that references in this disclosure to uncontaminated cleaning liquid mean liquid which in the course of use will become contaminated to some low level or degree, particularly in relation to the dirty cleaning liquid referred to in the discussion. It should also be understood that the cleaning liquid referred to in this disclosure is frequently water or water combined with a detergent or other chemical cleaning agent. However, it should also be understood that the cleaning liquid may be predominantly a liquid chemical cleaning agent alone or in combination with one or more other chemical cleaning agents.

In most wash buckets that are not compartmentalized the initially clean wash liquid becomes dirty and contaminated each time the dirty mop or other cleaning device is squeezed or wrung to discharge its dirty wash liquid load. In cases where the mop or other cleaning device is immersed in the wash liquid without wringing out a dirty liquid load, the original wash liquid in the bucket quickly becomes dirty.

Also, buckets currently in use do not provide any means for limiting or eliminating mop contact with contaminants already residing at the bottom of said bucket. Further, they do not provide for minimizing or eliminating the effects of mop entry turbulence. Turbulence caused by mop entry in turn causes contaminants which have come out of solution and reside at the bottom of the bucket to reenter solution and thus recontaminate the mop. It should also be noted that buckets currently in use have flat bottoms. They, therefore, do not provide any means for facilitating the concentration and isolation of particulate material and other heavier than cleaning liquid contaminants away from the uncontaminated cleaning liquid.

SUMMARY OF THE INVENTION

Accordingly, it is an object of the present invention to provide for containment of dirty wash liquid and clean wash liquid separately and isolated form each other in a single container.

It is another object of the present invention to keep a mop that has had its dirty wash liquid discharged isolated from that discharge.

It is yet another object of the present invention to keep a mop entering the clean liquid reservoir from causing the particulate material resting on the bottom of said reservoir from becoming solution borne because of entry turbulence caused by the mop.

It is still another object of the invention to restrict mop entry into the clean liquid reservoir to minimize or eliminate mop access to particulate material at the bottom of said reservoir.

It is another object of the invention to segregate particulate material from the major volume of liquid in the clean liquid reservoir.

It is a further object of the present invention to permit flushing of the clean liquid reservoir into the discharge storage reservoir.

It is still another object of the invention to permit dirty water elimination from the bucket to a floor drain.

It is another object of the invention to eliminate the necessity for lifting said bucket for emptying.

Other objects and benefits and a fuller understanding of the invention may be had by referring to the following description and claims, taken in conjunction with the accompanying drawings in which:

DETAILED DESCRIPTION

Figure 2:
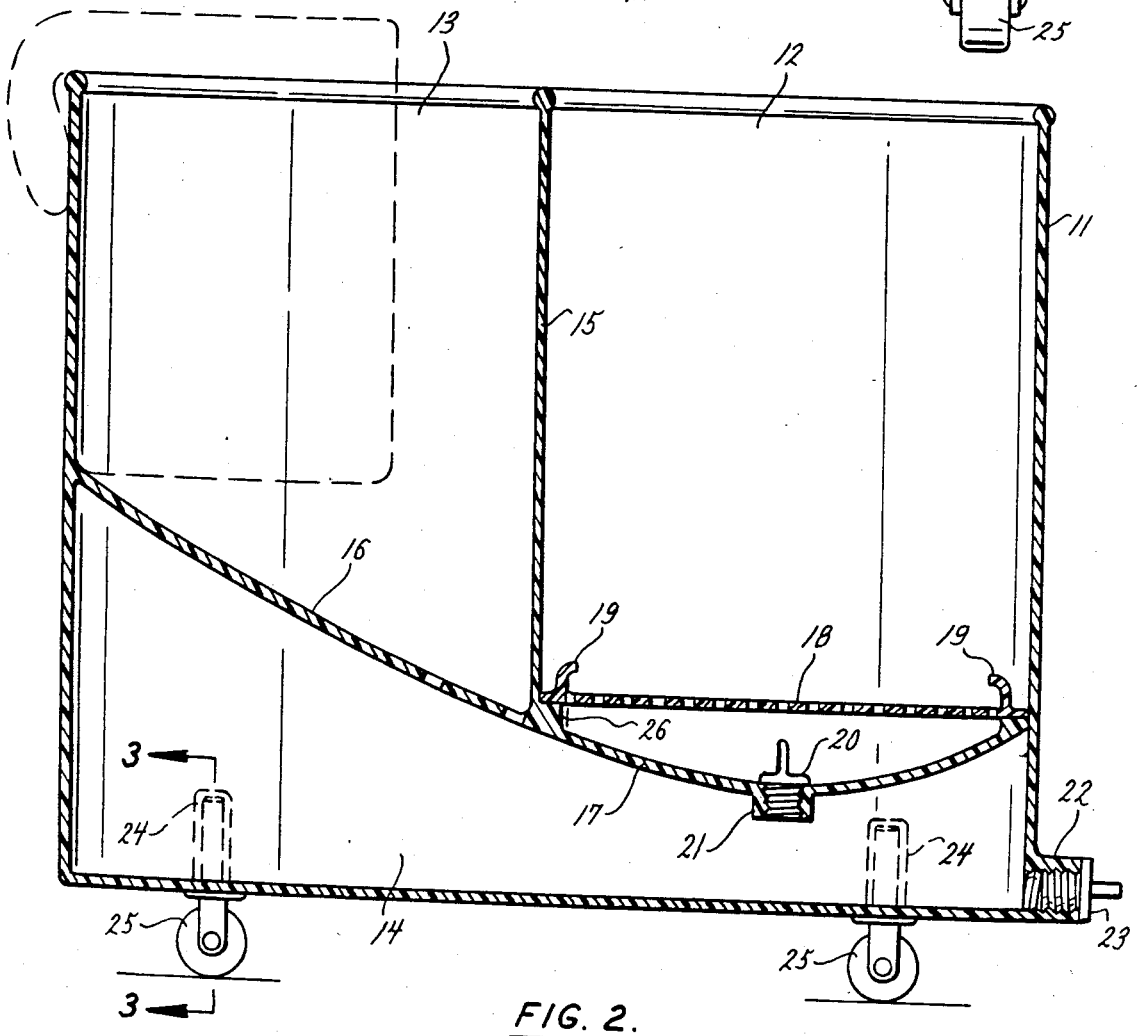
FIG. 2 is a cross-sectional side view of the invention.

With reference to FIG. 2, bucket 11 comprises clean liquid reservoir 12, discharge transfer compartment 13, and discharge storage reservoir 14. Wall 15 divides bucket 11 into two parts. The outer wall of bucket 11 combined with wall 15 and drain floor 16 define discharge transfer compartment 13. The outer wall of bucket 11 combined with wall 15 and collection floor 17 define clean liquid reservoir 12. Discharge storage reservoir 14 is located at the bottom of bucket 11 beneath clean liquid reservoir 12 and discharge transfer compartment 13.

Drain floor 16 of discharge transfer compartment 13 contains rows of holes adjacent to wall 15 to permit the immediate transfer of mop discharge, such as, for example, dirty water, to discharge storage reservoir 14. It further provides a resting place for a mop or other similar cleaning device and at the same time prevents the mop from which dirty wash liquid has been extracted from entering discharge storage reservoir 14 and the dirty or contaminated wash liquid residing therein.

FIG. 2 shows collection floor 17 at the bottom of clean liquid reservoir 12. Collection floor 17 is shaped to cause particulate material, transferred to the clean liquid from a mop in which it was retained after most of the dirty liquid was removed in discharge transfer compartment 13, to settle at the lowest point in clean liquid reservoir 12. Clean liquid discharge port 21 is located at the low point in collection floor 17. Clean liquid discharge plug 20 closes discharge port 21 when filling clean liquid reservoir 12 and is removed for emptying cleaning liquids after use through discharge storage reservoir 14.

Protective shelf 18, perforated with numerous holes, rests on shelf support 26 in clean liquid reservoir 12. Protective shelf 18 is perforated to permit residual particulate material entering the cleaning liquid, in the manner referred to above, to pass through for deposit on collection floor 17. Thus, direct mop access to such deposited material is prevented. Further, protective shelf 18 minimizes turbulence caused by mop entry from causing the deposited material to go back in suspension and, thus, becoming accessible to the mop along with otherwise clean liquid. Protective shelf 18 has two handles 19 for lifting and removing said shelf so that clean liquid reservoir 12 can be cleaned after use.

Figure 1:
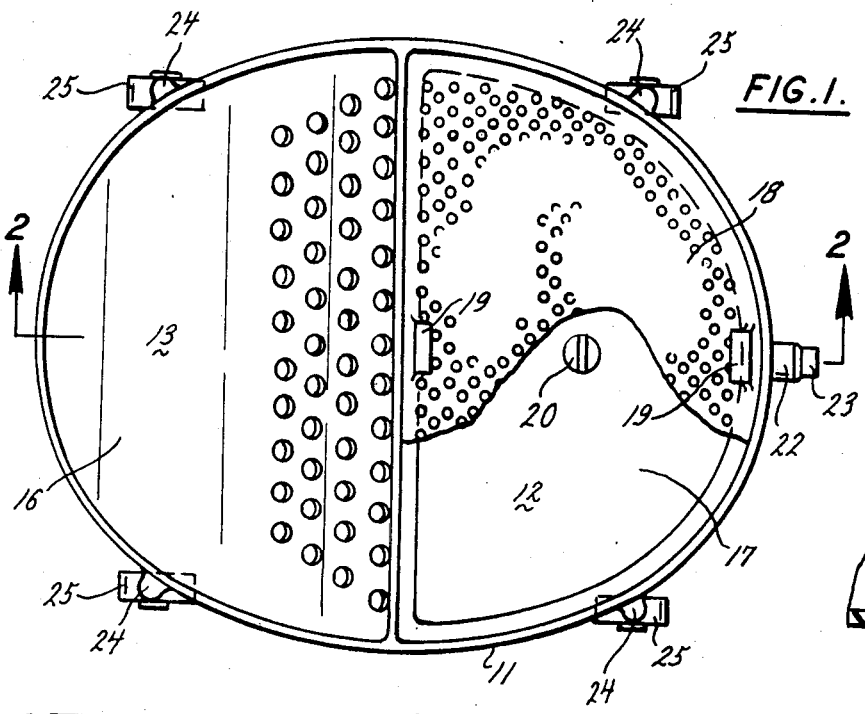
FIG. 1 is a top view of the invention.
Figure 3:
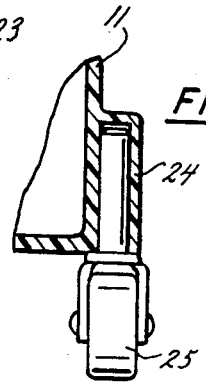
FIG. 3 is a cross-sectional view of a caster housing on the invention.

Dirty liquid discharge port 22 permits the emptying of bucket 11 into a floor drain to eliminate residual cleaning liquid or liquid used for flushing after use and prior to storage. Dirty liquid discharge plug 23 is used to open and close port 22, as required during use. The preferred embodiment of bucket 11, as shown, therefore, does not require lifting for emptying. For convenience in use, bucket 11 is shown in FIGS. 1 and 2 with four caster wheels inserted into each of four caster holders 24. FIG. 3 shows caster holders 24 molded integrally with bucket 11.

Bucket 11 may be fabricated from metal, such as stainless steel, from plastic, fiberglass, or other materials compatible with particular applications and permitting economical fabrication of adequate strength to accomplish all of the functions offered by the invention.

In the preferred embodiment bucket 11 is sized to accomodate a five (5) gallon capacity clean liquid reservoir 12 and a five (5) gallon discharge storage reservoir 14. Thus, a bucket shaped as shown in FIG. 1 and sixteen (16) inches high, twenty (20) inches in length, and sixteen (16) inches wide has been found to adequately accomodate these capacities.

Wall 15 divides the mouth of bucket 11 into substantially equal sectors. The size of discharge transfer compartment 13 is such than an off-the-shelf commercial mop wringer can be accomodated as shown in phantom in FIG. 2. Drain floor 16 in discharge transfer compartment 13 drops from its highest point eight (8) inches down from the top of one side of bucket 11 opposite wall 15 to its lowest point twelve (12) inches from the top of bucket 11 and adjacent to wall 15. The resultant slope of drain floor 16 enhances the transfer of dirty cleaning liquid and accompanying particulate material to discharge storage reservoir 14.

Collection floor 17 curves downward from its periphery twelve (12) inches down from the top of bucket 11 to its center located lowest point fourteen (14) inches down from the top of bucket 11. It should be noted in this embodiment of the invention that the respective tops of clean liquid reservoir 12 and discharge transfer compartment 13 coincide with the top of bucket 11.

The holes in protective shelf 18 shown in FIG. 1 are at least 0.125 inches in diameter to adequately accomodate the passage of particulate material introduced to clean liquid reservoir 12 by a wrung mop or other cleaning device. Protective shelf 18 rests on shelf support 26 ten (10) inches down in clean liquid reservoir 12 in order to prevent a mop being immersed in a clean liquid therein from coming into contact with particulate material or liquid contaminants residing below.

The holes in drain floor 16 of discharge transfer compartment 13 are half-inch (0.5 in.) in diameter to permit rapid transfer of dirty cleaning liquid carrying particulate material and slightly larger debris, introduced by a mop being wrung, through said compartment to discharge storage reservoir 14. Discharge port 21 is 1.25 inches in diameter to facilitate easy and quick emptying into discharge storage reservoir 14. Discharge port 21 is 0.75 inches in diameter and is closed during bucket 11 use with discharge port plug 20.

Although I have described my invention with a certain degree of particularity, it is understood that the present disclosure has been made only by way of example and that numerous changes in the details of construction and the combination and arrangement of parts may be restored to without departing from the spirit and scope of the invention as hereinafter claimed.

What is claimed is:

1. A bucket for handling cleaning liquids, comprising, a discharge storage reservoir, for containment of dirty cleaning liquid, located at the bottom of said bucket, a clean liquid reservoir, for containment of cleaning liquid, said reservoir located in a portion of the remaining volume of said bucket above and controllably connected to said discharge storage reservoir through a shaped collection floor, and further having a perforated protective shelf affixed within said clean liquid reservoir above said collection floor, and a discharge transfer compartment located in the remaining volume of said bucket above said discharge storage reservoir not occupied by said clean liquid reservoir, and adjoining said clean liquid reservoir by means of a common wall between the two, and further having a drain floor at its bottom connecting it with said discharge storage reservoir by means of drain holes located in said drain floor adjacent to said common wall, said drain floor further sloping down from a high point on the outer wall of said bucket to a lower level on said common wall.

2. The bucket of claim 1 wherein the bottom of said discharge transfer compartment comprises a drain floor having holes and sloping downward from the outer wall of said bucket to a lower level therein on the wall separating the discharge transfer compartment and the clean liquid reservoir within said bucket.

* * * * *